US008979585B2

(12) United States Patent
Oka et al.

(10) Patent No.: US 8,979,585 B2
(45) Date of Patent: Mar. 17, 2015

(54) CONNECTOR

(71) Applicant: Japan Aviation Electronics Industry, Limited, Shibuya-ku, Tokyo (JP)

(72) Inventors: Toshihiro Oka, Tokyo (JP); Akinori Kimura, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 28 days.

(21) Appl. No.: 14/018,351

(22) Filed: Sep. 4, 2013

(65) Prior Publication Data

US 2014/0080363 A1 Mar. 20, 2014

(30) Foreign Application Priority Data

Sep. 14, 2012 (JP) ..... 2012-203213

(51) Int. Cl.

| | |
|---|---|
| ***H01R 13/648*** | (2006.01) |
| ***H01R 13/502*** | (2006.01) |
| ***H01R 12/72*** | (2011.01) |
| ***H01R 13/6593*** | (2011.01) |
| *H01R 13/6594* | (2011.01) |

(52) U.S. Cl.

CPC ..... *H01R 13/502* (2013.01); *H01R 12/724* (2013.01); *H01R 13/6593* (2013.01); *H01R 13/6594* (2013.01)

USPC ..... 439/607.27

(58) Field of Classification Search

CPC ..... H01R 9/092; H01R 13/2442

USPC ..... 439/82, 567, 553, 862, 857, 660

See application file for complete search history.

(56) References Cited

U.S. PATENT DOCUMENTS

| | | | | |
|---|---|---|---|---|
| 5,417,593 | A * | 5/1995 | Suzuki et al. | 439/651 |
| 5,584,718 | A * | 12/1996 | Sukegawa | 439/352 |
| 5,836,774 | A * | 11/1998 | Tan et al. | 439/76.1 |
| 7,704,098 | B2 * | 4/2010 | Lambie et al. | 439/607.28 |
| 7,771,235 | B2 | 8/2010 | Kameyama | |
| 2013/0178100 | A1 | 7/2013 | Nagata et al. | |
| 2014/0057495 | A1 * | 2/2014 | Liao et al. | 439/660 |

FOREIGN PATENT DOCUMENTS

| | | |
|---|---|---|
| JP | 07-220816 A | 8/1995 |
| JP | 08-203617 A | 8/1996 |

(Continued)

OTHER PUBLICATIONS

Japanese Office Action dated Aug. 29, 2013 (and English translation thereof) in counterpart Japanese Application No. 2012-203213.

*Primary Examiner* — Phuongchi T Nguyen

(74) *Attorney, Agent, or Firm* — Holtz, Holtz, Goodman & Chick PC

(57) ABSTRACT

A connector comprises a contact, an inner housing, an inner shell, an outer housing and an outer shell. The inner housing holds the contact. The inner shell covers, at least in part, the inner housing. The outer housing holds the inner shell. The outer shell covers, at least in part, the outer housing. The inner shell has a connected portion and a connection portion. The connection portion extends from the connected portion and is directly connected with an attachment object when the connector is attached to the attachment object. A boundary between the connected portion and the connection portion is positioned apart from and rearward of the front end of the connector.

10 Claims, 8 Drawing Sheets

(56) References Cited

FOREIGN PATENT DOCUMENTS

| | | | |
|---|---|---|---|
| JP | 2005-038725 | A | 2/2005 |
| JP | 3117155 | U | 5/2006 |
| JP | 2008-103271 | A | 5/2008 |
| JP | 2009-043704 | A | 2/2009 |
| JP | 2009-301930 | A | 12/2009 |
| JP | 2012-074223 | A | 4/2012 |

* cited by examiner

CONNECTOR

CROSS REFERENCE TO RELATED APPLICATIONS

An Applicant claims priority under 35 U.S.C. §119 of Japanese Patent Application No. JP2012-203213 filed Sep. 14, 2012.

BACKGROUND OF THE INVENTION

The present invention relates to a connector, especially a connector comprising an inner shell and an outer shell.

Connectors of this type are disclosed in Patent Document 1 (JP A H7-220816) and Patent Document 2 (JPA 2008-103271), each of which is incorporated herein by reference in its entirety. As shown in FIG. 11, the connector disclosed in Patent Document 1 comprises an inner shell, an outer shell and a housing. The inner shell is inserted into and held by the housing. The housing which holds the inner shell is attached to the outer shell. The inner shell of the connector has a connection portion which is bent so as to extend upward from a front end of an upper part of the inner shell. The connection portion is configured to be fixed on a case, or the like, by screws. As shown in FIG. 12, Patent Document 2 discloses a connector which comprises another connection portion which is bent so as to extend in a width direction from a front end of an inner shell.

Each of the connectors disclosed in the Patent Document 1 and Patent Document 2 comprises the inner shell configured to be electrically connected with a mating shell of a mating connector (not shown in FIG. 11). The connection portion is provided on the front end of the inner shell so that the mating shell, the inner shell and the case constitute a ground path.

As understood from FIG. 12, if the mating connector is provided with a mating housing to cover the mating shell, the mating housing interferes with an inner connection portion of the inner shell. Therefore, the mating shell cannot be protected by provision of the mating housing. The illustrated structure of FIG. 12 has a problem that flaws formed on a connection surface of the mating shell or adherents put on the connection surface might cause a poor electrical connection between the mating shell and the inner shell.

SUMMARY OF THE INVENTION

It is therefore an object of the present invention to provide a connector which enables a direct-electrical connection between an inner shell of the connector and a case, while preventing the poor electrical connection between the inner shell and a mating shell.

One aspect of the present invention provides a connector having a front end and a rear end. The connector is attached to an attachment object and is inserted into a mating connector in a front-rear direction. The connector comprises a contact, an inner housing, an inner shell, an outer housing and an outer shell. The inner housing holds the contact. The inner shell covers, at least in part, the inner housing. The outer housing holds the inner shell. The outer shell covers, at least in part, the outer housing. The inner shell has a connected portion and a connection portion. The connection portion extends from the connected portion and is directly connected with the attachment object when the connector is attached to the attachment object. A boundary between the connected portion and the connection portion is positioned apart from and rearward of the front end of the connector.

An appreciation of the objectives of the present invention and a more complete understanding of its structure may be had by studying the following description of the preferred embodiment and by referring to the accompanying drawings.

Figure 1:
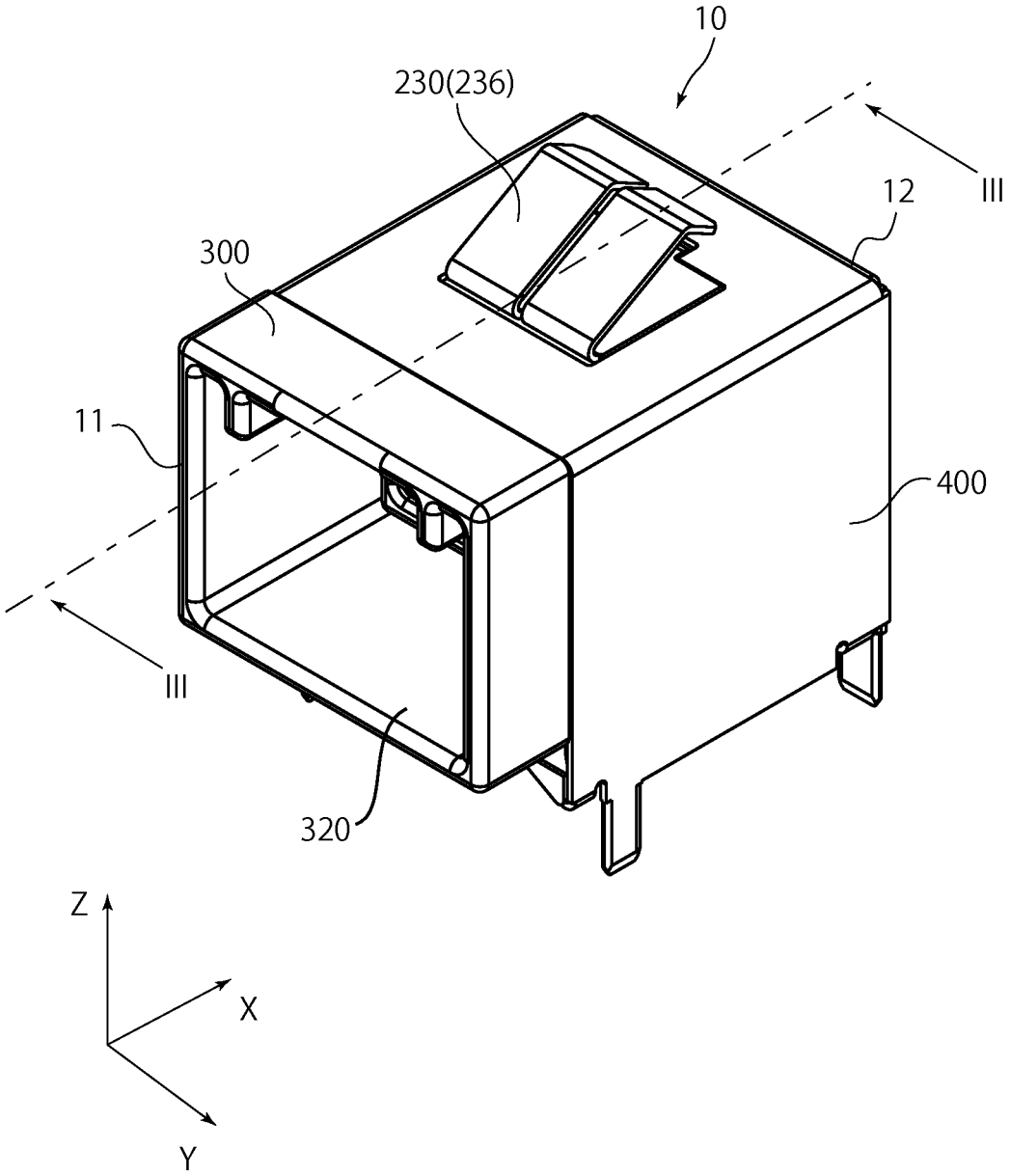
FIG. 1 is a perspective view showing a connector according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 2:
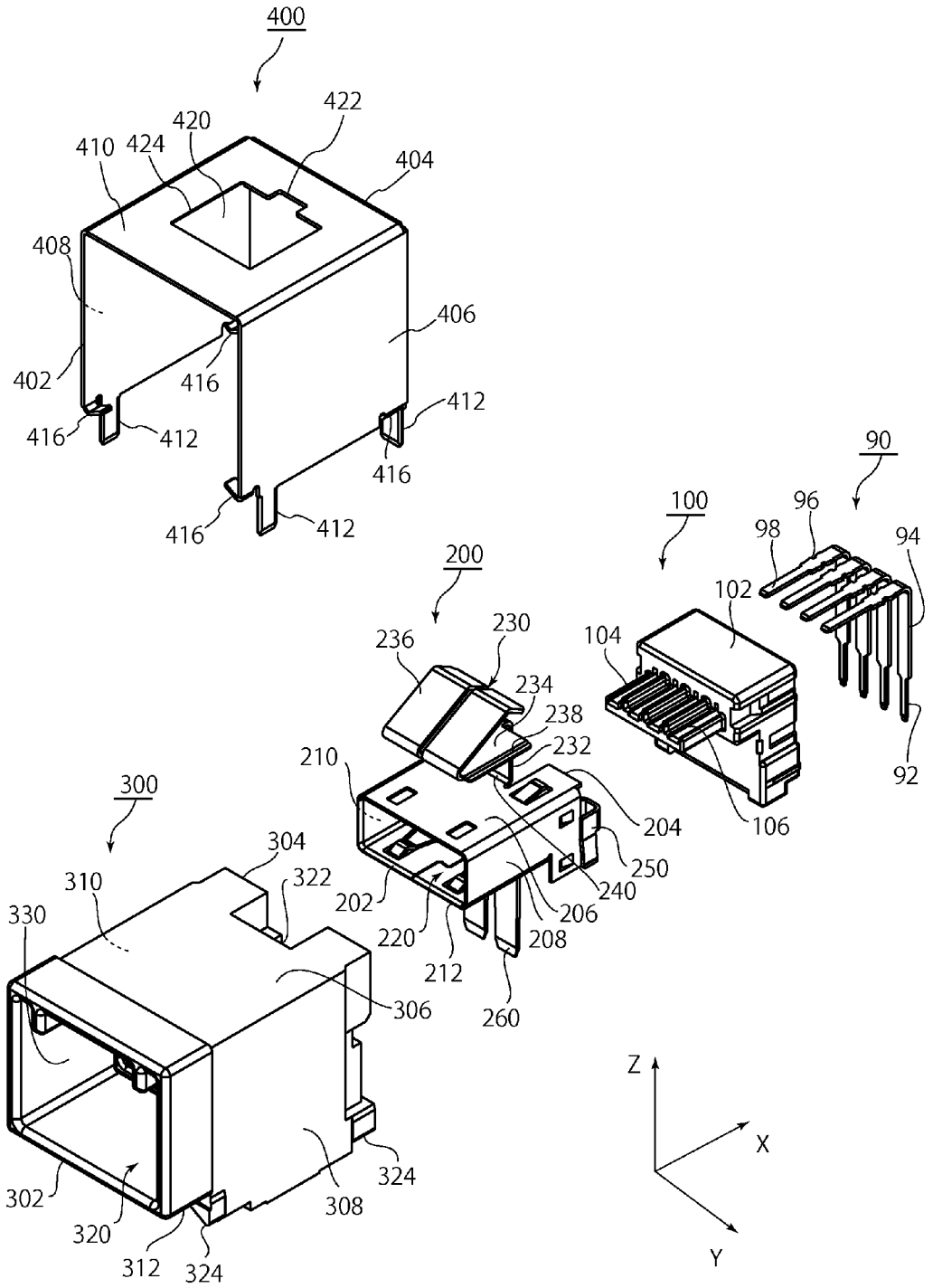
FIG. 2 is an exploded, perspective view showing the connector of FIG. 1.
Figure 3:
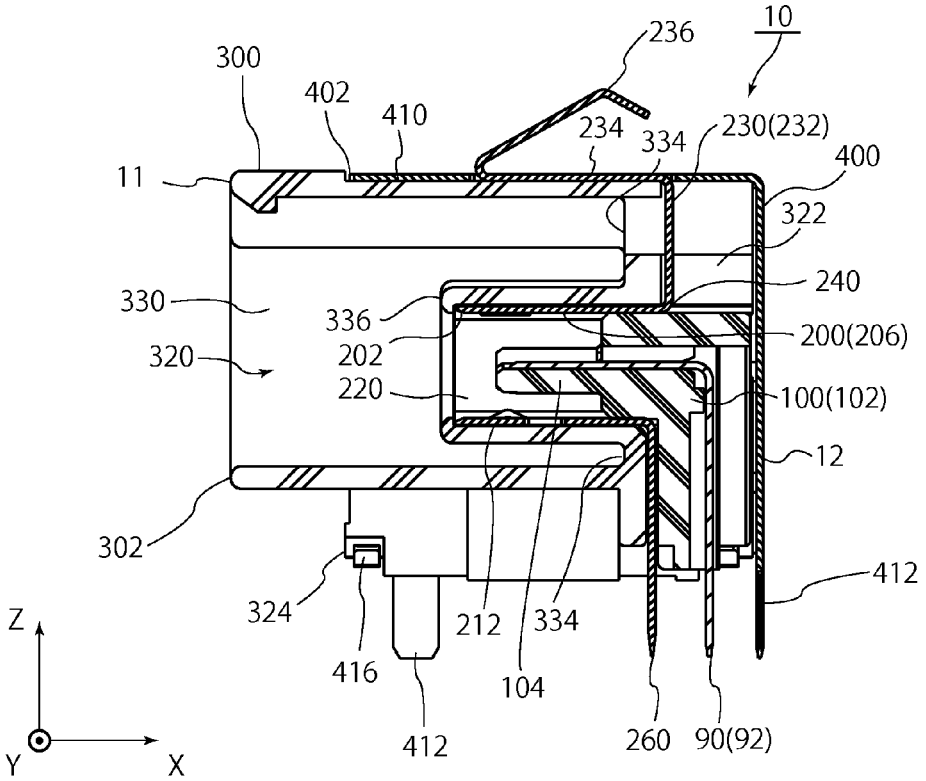
FIG. 3 is a cross-sectional view showing the connector of FIG. 1, taken along line III-III.

With reference to FIG. 1, a connector 10 according to a first embodiment of the present invention is configured to be attached to a case (attachment object: not shown), or the like. As shown in FIGS. 1 and 3, the connector 10 has a front end 11 and a rear end 12. As understood from FIGS. 1, 5 and 8, a mating connector 50 is inserted into and connected with the connector 10 along an X-direction (front-rear direction). As shown in FIG. 2 and FIG. 3, the connector 10 comprises four contacts 90, an inner housing 100, an inner shell 200, an outer housing 300 and an outer shell 400. The inner housing 100 holds the contacts 90. The inner shell 200 partially covers the inner housing 100. The inner shell 200 is inserted into the outer housing 300 so that the outer housing 300 holds the inner shell 200. The outer shell 400 partially covers the outer housing 300.

As shown in FIG. 2, the contact 90 has an L-like shape which is constituted by a vertical portion and a horizontal portion, wherein the vertical portion extends in a Z-direction (vertical direction) while the horizontal portion extends in the front-rear direction. The vertical portion has a base portion 94 and a fixing portion 92 configured to be fixed to a board. The horizontal portion has a press-fitted portion 96 and a connection portion 98. The press-fitted portion 96 is press-fitted into and fixed to the inner housing 100. The connection portion 98 is configured to electrically connected with the mating contact 510 (see FIG. 6) of the mating connector 50.

The inner housing 100 comprises a main body 102 and a protrusive portion 104 protruding forward from an upper portion of a front surface of the main body 102. The protrusive portion 104 is formed with grooves 106 configured to hold the horizontal portions of the contacts 90, respectively. The number of the grooves 106 according to the present embodiment is four and is same as the number of the contacts 90.

The inner shell 200 has a rectangular tube shape constituted by a front end 202, a rear end 204, an upper side portion 206 (connected portion), a side portion 208, a side portion 210 and a bottom side portion 212. The front end 202 is formed with an opening portion 220. As shown in FIG. 2, the upper side portion 206 of the inner shell 200 is perpendicular to the Z-direction. The upper side portion 206 is provided with a connection portion 230.

As shown in FIGS. 2 and 3, the connection portion 230 according to the present embodiment is formed by folding or bending a part of the inner shell 200 which includes the rear end 204. In detail, the connection portion 230 comprises a rising portion 232, a lid portion 234 and a spring portion 236. The rising portion 232 extends upward from the upper side portion 206. The lid portion 234 extends forward from an upper end of the rising portion 232. The spring portion 236 extends rearward and upward from a front end of the lid portion 234.

Figure 4:
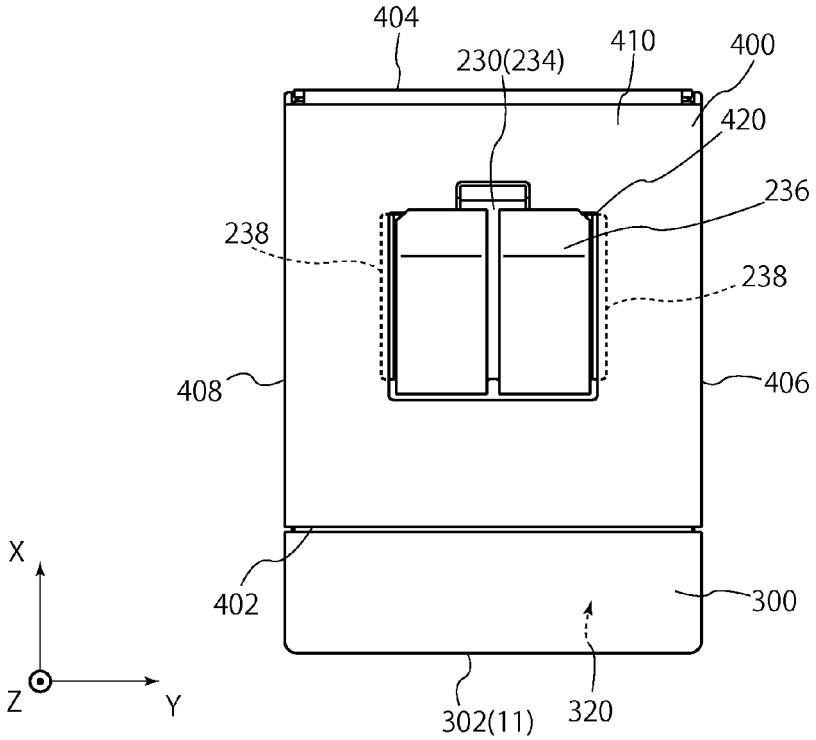
FIG. 4 is a top view of the connector of FIG. 1.

As understood from FIGS. 2 and 4, the lid portion 234 has a square shape. A size of the lid portion 234 is almost equal to a size of an opening portion 420 of the outer shell 400. Therefore, when the lid portion 234 is arranged within the opening portion 420, the lid portion 234 can close, at least in part, the opening portion 420. The connection portion 230 is further provided with two brim portions 238, which are positioned at opposite ends of the lid portion 234 in the Y-direction and extend from the lid portion 234 in the Y-direction. An upper surface of each brim portion 238 is lower than an upper surface of the lid portion 234. As illustrated with dotted lines in FIG. 4, in the Y-direction, a total size of the lid portion 234 and the brim portions 238 is larger than the size of the opening portion 420 of the outer shell 400. The brim portions 238 are positioned inside the outer shell 400 (under the upper side portion 410) when the lid portion 234 is arranged in the opening portion 420. In other words, in a state shown in FIG. 4, the upper side portion 410 of the outer shell 400 overlaps the brim portions 238 in the Z-direction. The whole of the brim portions 238 are not visible from above the outer shell 400. Namely, the outer shell 400 hides, at least in part, the brim portions 238. With this structure, the connection portion 230 is prevented from moving upward of the upper side portion 410 in the Z-direction. Thus, the brim portions 238 serve as a stopper portion which prevents the connection portion 230 from being deformed or moving upwardly. In addition, undesired clearances between the lid portion 234 and inner side edges 424 of the opening portion 420 can be reduced. Therefore, a shield effect can be further improved.

The spring portion 236 according to the present embodiment is divided into two parts in the Y-direction. The spring portion 236 is configured to be brought into contact with the case so that the case is electrically and directly connected with the inner shell 200 through the connection portion 230. The shapes or the number of the spring portions 236 may be changed in accordance with a required spring force or a shape of the case.

As shown in FIG. 2, the inner shell 200 has auxiliary connection portions 250 extending from rear ends of the side portions 208 and 210, i.e. the rear end 204. Each of the auxiliary connection portions 250 has an L-shape when seen along the Z-direction. The auxiliary connection portions 250 are connected with the outer shell 400 when the connector 10 is fabricated. As understood from FIGS. 2 and 3, the bottom side portion 212 is formed with fixing portions 260 extending downward. The fixing portions 260 are to be fixed to the board, or the like.

The outer housing 300 has a rectangular tube shape constituted by a front end 302, a rear end 304, a side portion 308, a side portion 310, an upper side portion 306 and a bottom side portion 312. The front end 302 is formed with an opening portion 320. As understood from FIGS. 1 and 3, the front end 302 of the outer housing 300 is positioned foremost of the connector 10. In other words, the front end 302 of the outer housing 300 is the front end 11 of the connector 10. The opening portion 320 of the outer housing 300 is an opening portion of the connector 10. The rear end 304 of the outer housing 300 is formed with a recessed portion 322. The recessed portion 322 is recessed forward. As shown in FIG. 3, when the inner shell 200 is attached to the outer housing 300, the rising portion 232 of the connection portion 230 of the inner shell 200 is positioned in the recessed portion 322 of the outer housing 300, and the lid portion 234 is positioned on the upper side portion 306 of the outer housing 300. As shown in FIGS. 2 and 3, the outer housing 300 has four held portions 324 protruding downward. The held portions 324 are formed at front ends and rear ends of bottom parts of the side portions 308 and 310.

Figure 5:
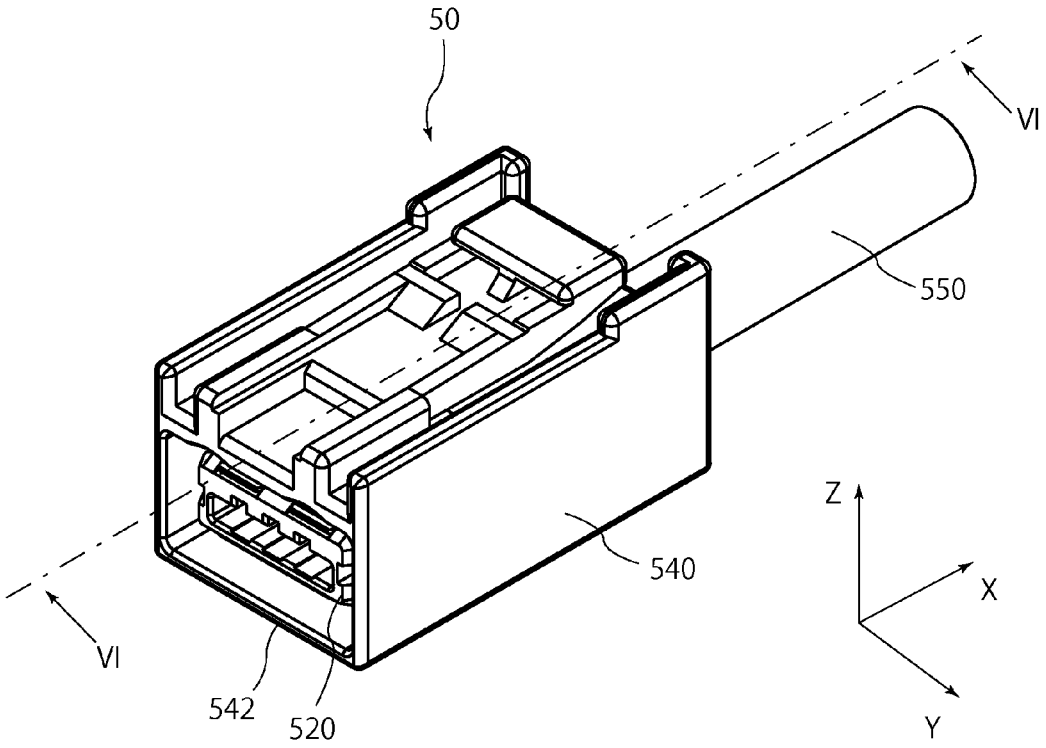
FIG. 5 is a perspective view showing a mating connector configured to be inserted into the connector of FIG. 1.
Figure 8:
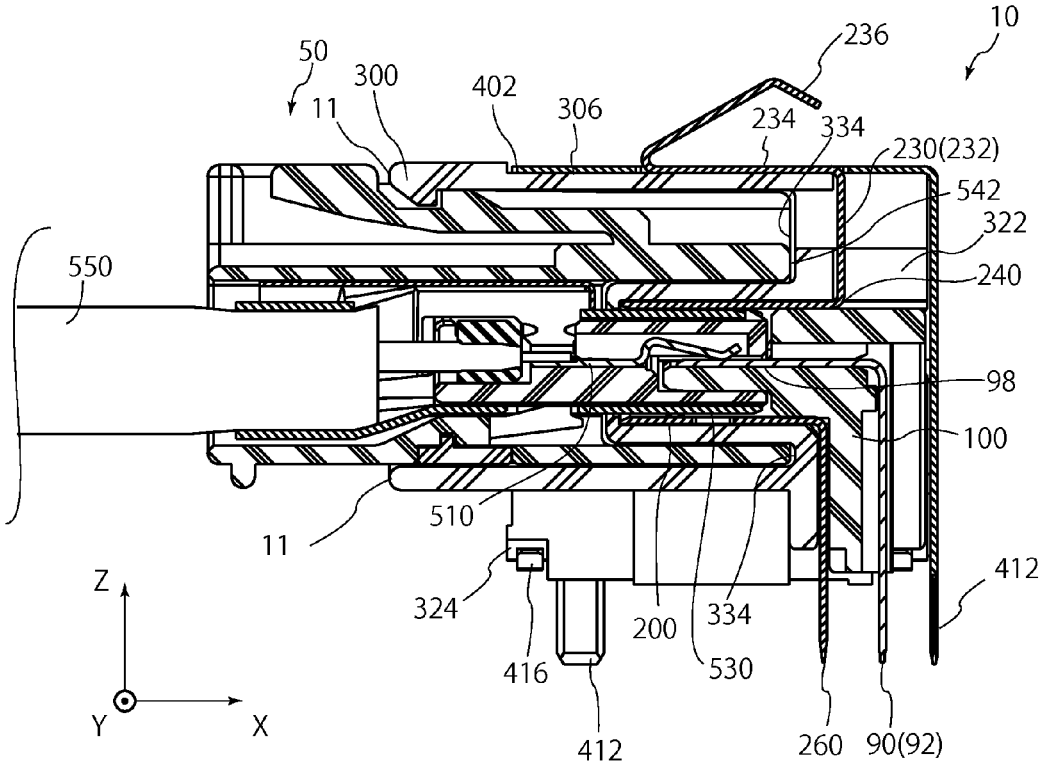
FIG. 8 is a cross-sectional view showing a connection state between the connector of FIG. 3 and the mating connector of FIG. 6.

As shown in FIG. 3, the outer housing 300 has an accommodation portion 330 for accommodating the mating connector 50 (see FIG. 5). The outer housing 300 comprises a shell-accommodation portion 336 protruding forward from the innermost surface of the accommodation portion 330. The inner shell 200 is inserted and accommodated in the shell-accommodation portion 336 through the rear end 12 of the connector 10. As shown in FIG. 8, the innermost surface of the accommodation portion 330 according to the present embodiment serves as an inner portion 334 configured to be brought into contact with a front end 542 of the mating connector 50.

With reference to FIG. 2 and FIG. 3, a boundary 240 between the upper side portion 206 of the inner shell 200 and the connection portion 230 is positioned apart from and rearward of the front end 11 of the connector 10. In other words, the boundary 240 is positioned closer to the rear end 12 than the front end 11 of the connector 10. In the X-direction, a distance between the boundary 240 and the rear end 12 is shorter than another distance between the front end 11 and the rear end 12. In detail, as shown in FIG. 3, the boundary 240 is positioned rearward of the front end 202 of the inner shell 200 and is positioned rearward of the inner portion 334. In other words, the front end 11 of the connector 10 (i.e. the front end 302 of the outer housing 300), the front end 202 of the inner shell 200, the inner portion 334 and the boundary 240, or the rising portion 232, are positioned in this order in the X-direction.

The outer shell 400 has a front end portion 402, a rear side portion 404, a side portion 406, side portion 408 and an upper side portion 410. Each of the side portions 406 and 408 has two holding portions 416, which are positioned close to a front end and a rear end, respectively. The holding portions 416 extend downward of the side portions 406, 408 before the connector 10 is fabricated. When the outer shell 400 is attached to the outer housing 300, the holding portions 416 are bend inward to engage with the held portions 324, respectively. Thus, the outer shell 400 is fixed to the outer housing 300. Each of the side portion 406, the side portion 408 and the rear side portion 404 is formed with one or two fixing portions 412 which are configured to be fixed to the board, or the like. The fixing portions 412 extend downward.

As shown in FIGS. 1 and 2, the opening portion 420 is formed in the upper side portion 410 of the outer shell 400. A recessed portion 422 is formed at a rear end of the opening portion 420 and is recessed rearward. As shown in FIGS. 1 and 4, the spring portion 236 of the connection portion 230 protrudes upward through the opening portion 420. The spring portion 236 is brought into contact with the case so that the inner shell 200 is electrically connected with the case. According to the present embodiment, the reaction force of the spring portion 236 ensures the connection between the connection portion 230 and the case.

Figure 6:
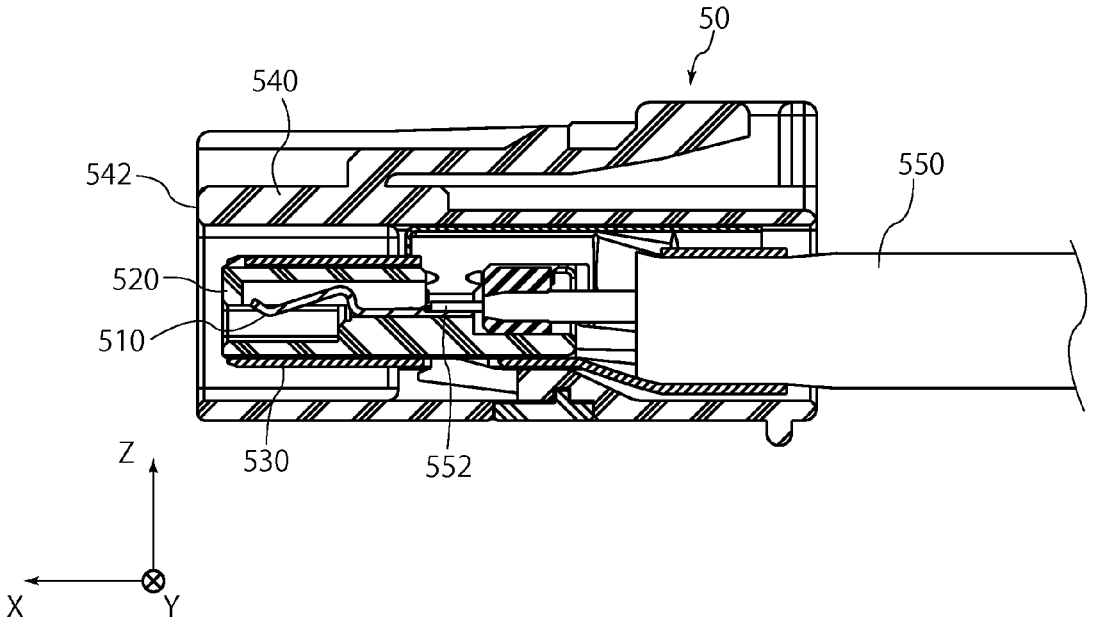
FIG. 6 is a cross-sectional view showing the mating connector of FIG. 5, taken along line VI-VI.
Figure 7:
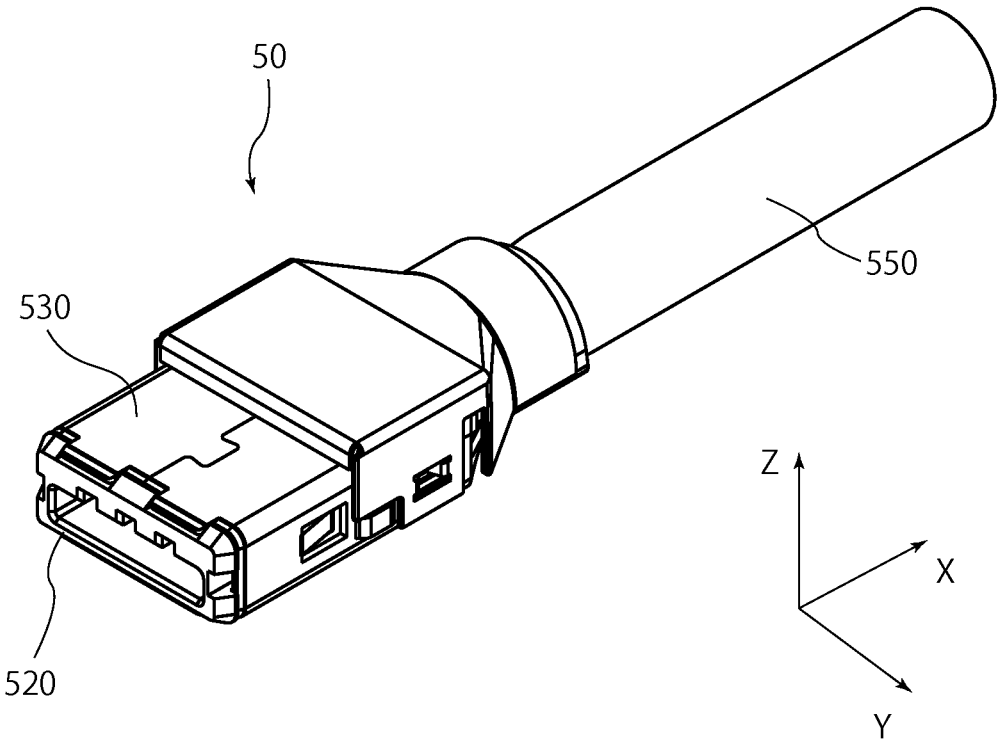
FIG. 7 is a perspective view showing the mating connector of FIG. 5. A mating outer housing is not illustrated.

As shown in FIGS. 5 and 6, the mating connector 50 comprises mating contacts 510, a mating inner housing 520, a mating shell 530 and a mating outer housing 540. The mating inner housing 520 holds the mating contacts 510. The mating shell 530 is attached to the mating inner housing 520 to cover the mating inner housing 520. The mating outer housing 540 covers the mating shell 530. The mating contacts 510 are connected with conductive lines 552 of a cable 550. As shown in FIG. 7, the mating shell 530 according to the present embodiment surrounds the periphery (all side surfaces in parallel with the X-direction) of the mating inner housing 520.

As understood from FIGS. 1 to 3, the connector 10 is fabricated by press-fitting the contacts 90 into the inner housing 100, followed by inserting the inner housing 100 into the inner shell 200 through the rear end 204, further followed by inserting the inner shell 200 into the outer housing 300 through the rear end 304, still further followed by attaching the outer shell 400 to the outer housing 300.

As shown in FIG. 8, the mating connector 50 is inserted into the connector 10 through the front end 11. In the connection state, the mating shell 530 is accommodated in the opening portion 220 of the inner shell 200. A front end 542 of the mating connector 50 is close to or brought into contact with the inner portion 334 of the outer housing 300. The mating contacts 510 are electrically connected with the connection portions 98 of the contacts 90. The mating shell 530 of the mating connector 50 is electrically connected with the inner shell 200. As described above, the connection portion 230 of the inner shell 200 is directly and electrically connected with the case. Thus, the mating shell 530 is directly and electrically connected with the case. Namely, the present embodiment can ensure a ground path between the mating shell 530 and the case.

Figure 12:
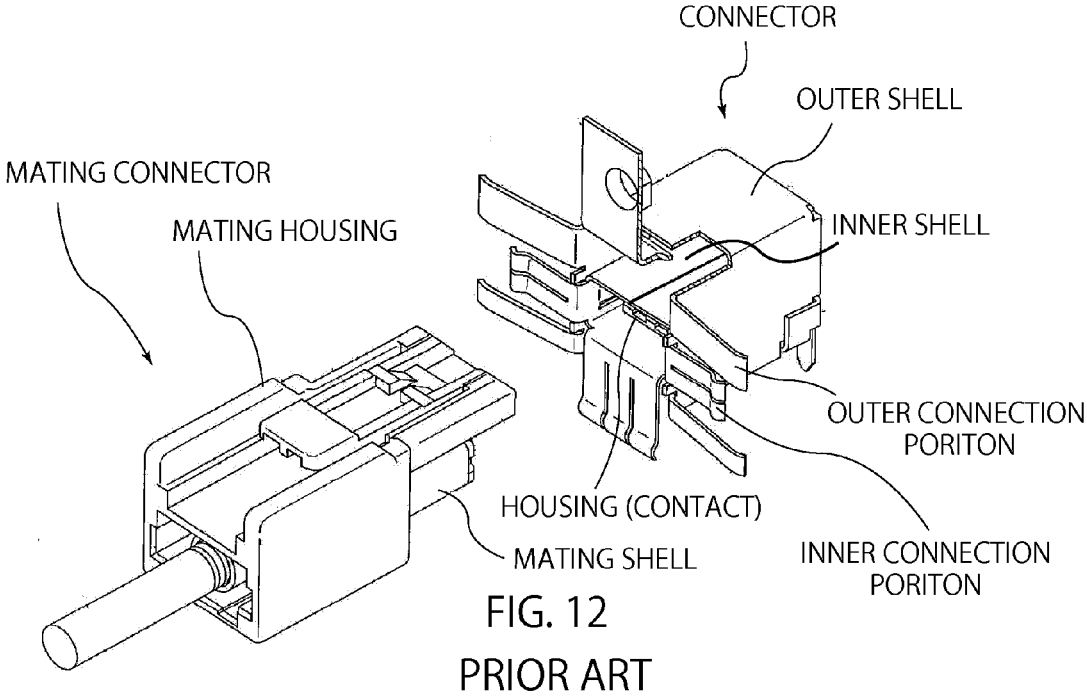
FIG. 12 PRIOR ART
FIG. 12 is a perspective view showing a connector and a mating connector of Patent Document 2.

As explained above, according to the present embodiment, the boundary 240 between the connection portion 230 and the inner shell 200 is positioned rearward of the inner portion 334. With this structure, the connector 10 can be connected (mated) with the mating connector 50 without mutual interference between the inner shell 200 (especially, the connection portion 230) and the mating connector 50. Unlike the mating connector of Patent Document 2 (see FIG. 12), the mating shell 530 is covered by the mating outer housing 540 but is not exposed so that the mating shell 530 is protected. Thus, flaws can be prevented from being made on a connection surface of the mating shell 530 and adherents can be prevented from being put thereon. Accordingly, a poor connection due to such flaws or adherents is prevented.

As shown in FIG. 3, the boundary 240 or the rising portion 232 according to the present embodiment is positioned rearward of the inner portion 334 in the X-direction. However, the position of the boundary 240 or the rising portion 232 and the position of the inner portion 334 may be same as each other. In other words, the rising portion 232 of the connection portion 230 may be used as the inner portion 334. In the present embodiment, the boundary 240 is positioned rearward of the front end 11 of the connector 10 so that an overlapping portion or a mutual interference portion between the connection portion 230 and the mating connector 50 can be reduced in the X-direction. The mating shell 530 is, at least in part, surround by the mating outer housing 540 so that the mating shell 530 can be protected. In order to surround more extensively, it is preferable that the boundary 240 or the rising portion 232 is positioned rearward of the front end 202 or the opening portion 220 of the inner shell 200, and it is more preferable that that the boundary 240 or the rising portion 232 is positioned rearward of the front end 542 the mating connector 50 in the connection state of the connector 10 and the mating connector 50. Namely, it is most preferable that the boundary 240 or the rising portion 232 is positioned rearward of the inner portion 334 as the present embodiment shown in FIG. 3. According to the present embodiment, the mating connector 50 has flexibility on design of the front end 542 because the front end 542 does not interfere with the connection portion 230. For example, that flexibility allows a well-known or existing mating connector to be used as the mating connector for the connector 10 of the present embodiment.

As shown in FIG. 2, the connection portion 230 according to the present embodiment is formed by folding forward a part of the inner shell 200 which bridges between the upper side portion 206 and the rear end 204. The connection portion 230 may be formed by folding backward a front part of the upper side portion 206 which includes the front end 202. However, the upper side portion 206 is formed with a recessed portion recessed rearward of the front end 202. Therefore, the present embodiment shown in FIG. 2 is preferable in aspects of strength and shield properties.

The connection portion 230 according to the present embodiment is formed on the upper side portion 206 of the inner shell 200. The connection portion 230 may be formed on a surface intersecting (preferably, perpendicular to) a direction perpendicular to the X-direction: i.e. the side portion 208, the side portion 210 or the bottom side portion 212. In this connection, the recessed portion 322 of the outer housing 300 and the opening portion 420 of the outer shell 400 are formed in correspondence with the connection portion 230. Furthermore, although the number of the connection portion 230 of the present embodiment is one, the inner shell 200 may be provided with a plurality of the connection portions 230.

A connection member, e.g., a conductive spring or other conductive members, may be attached to the outer shell 400 or the case to electrically connect the outer shell 400 with the case so that the electrical connection resistance is lowered. The spring portion 236 of the inner shell 200 may be changed to another conductive member.

Second Embodiment

Figure 9:
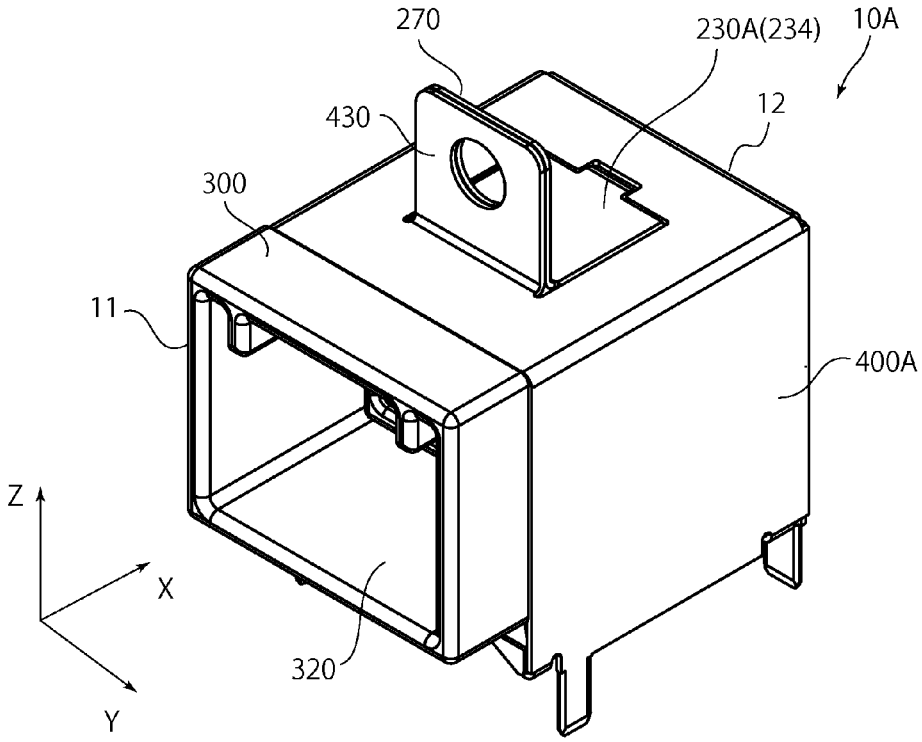
FIG. 9 is a perspective view showing a connector according to a second embodiment of the present invention.
Figure 10:
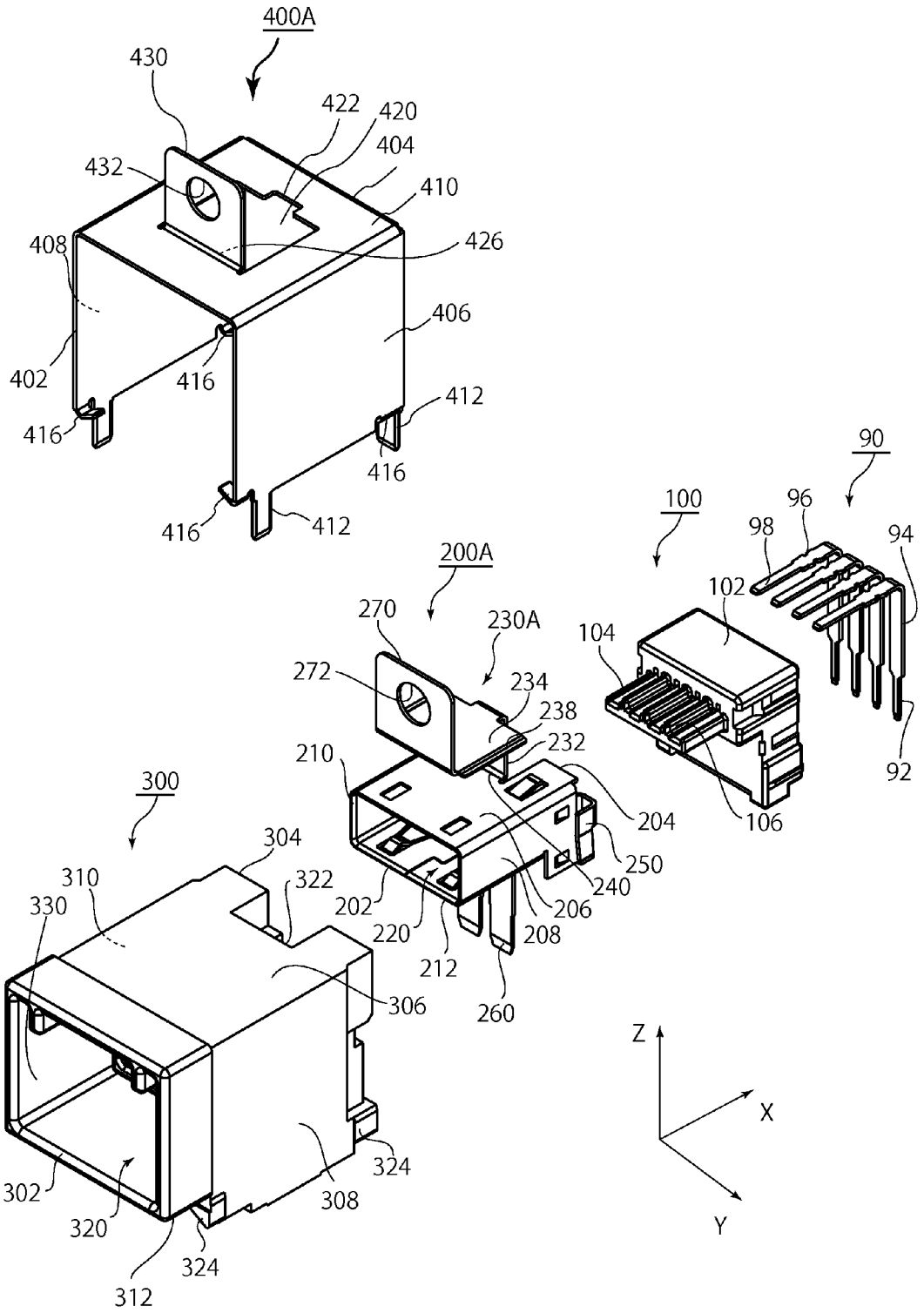
FIG. 10 is an exploded, perspective view showing the connector of FIG. 9.
Figure 11:
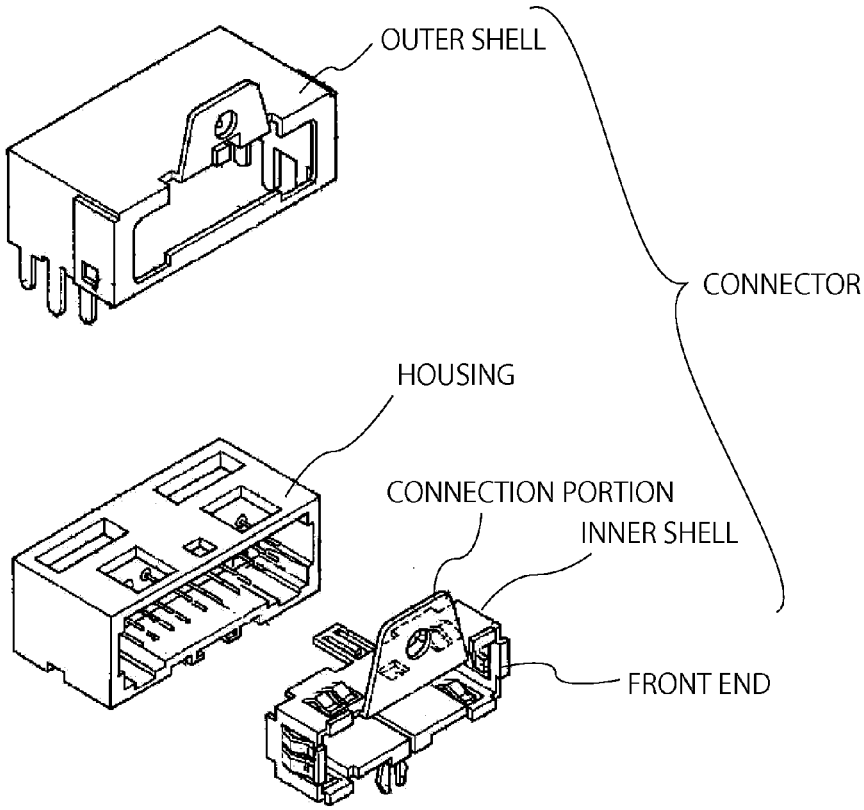
FIG. 11 PRIOR ART
FIG. 11 is an exploded, perspective view showing a connector of Patent Document 1.

As understood from FIGS. 1, 2, 9 and 10, a connector 10A according to a second embodiment of the present invention has a similar structure to the connector 10 according to the first embodiment, except for an inner shell 200A and an outer shell 400A. Common components between FIG. 2 and FIG. 10 are depicted with reference numerals same as each other;

explanation thereabout will be omitted. Thus, the inner shell 200A and the outer shell 400A will be mainly explained hereinafter.

The upper side portion 206 of the inner shell 200A is formed with a connection portion 230A. The connection portion 230A is formed by folding forward a part of the inner shell 200A which bridges between the upper side portion 206 and the rear end 204, so that the folded portion extends upward. The connection portion 230A comprises the rising portion 232, the lid portion 234 and a flange 270. The rising portion 232 extends from the boundary 240 along the Z-direction. The lid portion 234 extends forward from the upper end of the rising portion 232. The flange 270 extends upward from the front end of the lid portion 234.

The flange 270 extends upward at an angle of 90 degrees with respect to the lid portion 234. The flange 270 is formed with an attachment hole 272.

The upper side portion 410 of the outer shell 400A is formed with the opening portion 420. The front end portion 426 of the opening portion 420 is formed with a flange 430 extending upward at an angle of 90 degrees with respect to the upper side portion 410. The flange 430 is formed with an attachment hole 432. As shown in FIG. 9, when the connector 10A is fabricated, the flange 270 of the inner shell 200A and the flange 430 of the outer shell 400A overlap each other in the X-direction while the attachment hole 272 of the flange 270 and the attachment hole 432 of the flange 430 are aligned. The flanges 270 and 430 of the connector 10A are screwed on the case.

The present application is based on a Japanese patent application of JP2012-203213 filed before the Japan Patent Office on Sep. 14, 2012, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector having a front end and a rear end, the connector being attached to an attachment object and being inserted into a mating connector in a front-rear direction, wherein:

the connector comprises a contact, an inner housing, an inner shell, an outer housing and an outer shell;

the inner housing holds the contact;

the inner shell covers, at least in part, the inner housing;

the outer housing holds the inner shell;

the outer shell covers, at least in part, the outer housing;

the inner shell has a connected portion and a connection portion;

the connection portion extends from the connected portion and is directly connected with the attachment object when the connector is attached to the attachment object; and a boundary between the connected portion and the connection portion is positioned apart from and rearward of the front end of the connector.

2. The connector as recited in claim 1, wherein the connection portion is formed by folding or bending a part of the inner shell which includes a rear end of the connection portion.

3. The connector as recited in claim 1, wherein the connection portion has a spring portion which is brought into contact with the attachment object when the connector is attached to the attachment object.

4. The connector as recited in claim 1, wherein the connection portion has an attachment portion attached to the attachment object when the connector is attached to the attachment object.

5. The connector as recited in claim 1, wherein:

a front end of the inner shell is positioned rearward of the front end of the connector; and the boundary is positioned rearward of the front end of the inner shell.

6. The connector as recited in claim 5, further having an inner portion which is brought into contact with a front end of the mating connector when the connector and the mating connector are mated, wherein:

the inner portion is positioned rearward of the front end of the inner shell; and the boundary is positioned at position same as the inner portion or is positioned rearward of the inner portion in the front-rear direction.

7. The connector as recited in claim 6, wherein the inner portion is provided for the outer housing.

8. The connector as recited in claim 1, wherein:

the outer shell has an opening portion; and the connection portion is connected with the attachment object through the opening portion when the connector is attached to the attachment object.

9. The connector as recited in claim 8, wherein the connection portion has a lid portion which closes, at least in part, the opening portion.

10. The connector as recited in claim 9, wherein the lid portion comprises a brim portion which overlaps, at least in part, the outer shell and is positioned inside of the outer shell.

* * * * *